US012116657B2

(12) United States Patent
Mizutani et al.

(10) Patent No.: US 12,116,657 B2
(45) Date of Patent: Oct. 15, 2024

(54) AUSTENITIC-FERRITIC DUPLEX STAINLESS STEEL SHEET

(71) Applicant: JFE STEEL CORPORATION, Tokyo (JP)

(72) Inventors: Akito Mizutani, Tokyo (JP); Mitsuyuki Fujisawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 445 days.

(21) Appl. No.: 17/630,914

(22) PCT Filed: Jun. 4, 2020

(86) PCT No.: PCT/JP2020/022194
§ 371 (c)(1),
(2) Date: Jan. 28, 2022

(87) PCT Pub. No.: WO2021/019909
PCT Pub. Date: Feb. 4, 2021

(65) Prior Publication Data

US 2022/0267883 A1 Aug. 25, 2022

(30) Foreign Application Priority Data

Jul. 31, 2019 (JP) ..... 2019-141342

(51) Int. Cl.
*C22C 38/58* (2006.01)
*C21D 8/02* (2006.01)
(Continued)

(52) U.S. Cl.
CPC ..... *C22C 38/58* (2013.01); *C21D 8/0205* (2013.01); *C21D 8/0226* (2013.01); *C21D 9/46* (2013.01);
(Continued)

(58) Field of Classification Search
CPC ..... C22C 38/58; C22C 38/001; C22C 38/002; C22C 38/02; C22C 38/42; C22C 38/44; C22C 38/54; C21D 8/0205; C21D 8/0226; C21D 9/46; C21D 2211/001; C21D 2211/005
See application file for complete search history.

(56) References Cited

U.S. PATENT DOCUMENTS 6,306,341 B1 10/2001 Yokota et al.
9,212,412 B2 12/2015 Oikawa et al.
(Continued)

FOREIGN PATENT DOCUMENTS

CN 101194037 A 6/2008
CN 101768694 A 7/2010
(Continued)

OTHER PUBLICATIONS

Yonenaga Yosuke et.al. [JP2017002352A] (Machine Translation) (Year: 2017).*
(Continued)

*Primary Examiner* — Brian D Walck
*Assistant Examiner* — Nazmun Nahar Shams
(74) *Attorney, Agent, or Firm* — KENJA IP LAW PC

(57) ABSTRACT

A predetermined chemical composition is contained, and a predetermined relationship of the contents of Ag, B and REM is satisfied.

4 Claims, 2 Drawing Sheets

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/42*** | (2006.01) |
| ***C22C 38/44*** | (2006.01) |
| ***C22C 38/54*** | (2006.01) |

(52) U.S. Cl.

CPC ..... *C22C 38/001* (2013.01); *C22C 38/002* (2013.01); *C22C 38/02* (2013.01); *C22C 38/42* (2013.01); *C22C 38/44* (2013.01); *C22C 38/54* (2013.01); *C21D 2211/001* (2013.01); *C21D 2211/005* (2013.01)

(56) References Cited

U.S. PATENT DOCUMENTS

| | | | |
|---|---|---|---|
| 2007/0163679 | A1 | 7/2007 | Fujisawa et al. |
| 2008/0107559 | A1 | 5/2008 | Nishiyama et al. |
| 2014/0219856 | A1 | 8/2014 | Oliver et al. |
| 2019/0055634 | A1 | 2/2019 | Nishida et al. |
| 2019/0300980 | A1 | 10/2019 | Hayashi et al. |
| 2019/0390310 | A1 | 12/2019 | Mizutani et al. |

FOREIGN PATENT DOCUMENTS

| | | | |
|---|---|---|---|
| CN | 102191440 | A | 9/2011 |
| CN | 103890214 | A | 6/2014 |
| CN | 106011689 | A | 10/2016 |
| CN | 107881413 | A | 4/2018 |
| CN | 108138278 | A | 6/2018 |
| JP | H10259456 | A | 9/1998 |
| JP | 2000054082 | A | 2/2000 |
| JP | 2000129406 | A | 5/2000 |
| JP | 2010229459 | A | 10/2010 |
| JP | 2012126992 | A | 7/2012 |
| JP | 5345070 | B2 | 11/2013 |
| JP | 2016180172 | A | 10/2016 |
| JP | 2016191149 | A | 11/2016 |
| KR | 1020090005252 | A | 1/2009 |
| WO | 2017141907 | A1 | 8/2017 |
| WO | 2018135554 | A1 | 7/2018 |

OTHER PUBLICATIONS

Liu Xiao et.al. [CN107881413A (Machine Translation (Year: 2018).*

Yang Jun et.al. [CN101376954A] (Machine Translation) (Year: 2009).*

Ueda Shigenori, et.al. [JP2010174334A] (Machine Translation) (Year: 2010).*

Aug. 31, 2023, Office Action issued by the Korean Intellectual Property Office in the corresponding Korean Patent Application No. 10-2022-7004321 with English language concise statement of relevance.

Jul. 28, 2020, International Search Report issued in the International Patent Application No. PCT/JP2020/022194.

Apr. 27, 2023, Office Action issued by the China National Intellectual Property Administration in the corresponding Chinese Patent Application No. 202080055256.6 with English language search report.

Oct. 5, 2022, the Extended European Search Report issued by the European Patent Office in the corresponding European Patent Application No. 20847927.9.

* cited by examiner

AUSTENITIC-FERRITIC DUPLEX STAINLESS STEEL SHEET

TECHNICAL FIELD

This disclosure relates to an austenitic-ferritic duplex stainless steel sheet having high proof stress and excellent microbial corrosion resistance.

BACKGROUND

Ferritic-austenitic duplex stainless steel (hereinafter also referred to as duplex stainless steel) is a steel having a duplex microstructure of ferrite (α) and austenite (γ) at room temperature. The duplex stainless steel is also characterized by high strength (high proof stress) and excellent stress corrosion cracking resistance. Further, the duplex stainless steel is a steel that has attracted much attention in recent years from the viewpoint of saving rare elements, because its Ni content is lower than that of austenitic stainless steel.

Examples of the duplex stainless steel include those specified in JIS G 4304 and JIS G 4305, where JIS G 4304 and JIS G 4305 specify three types of general-purpose duplex stainless steels, one type of super duplex steel, and two types of lean (resource savings, with low Ni content) duplex steels, respectively.

Among these, SUS821L1 (representative components: 22 mass % Cr-2 mass % Ni-0.5 mass % Mo-1 mass % Cu-0.18 mass % N), which is a lean duplex stainless steel, is a steel having a particularly low Ni content as compared with conventional general-purpose duplex steels such as SUS329J3L (representative components: 22 mass % Cr-5 mass Ni %-3 mass % Mo-0.16 mass % N).

Examples of duplex stainless steel with a chemical composition the same as that of SUS821L1 include the one described in JP 5345070 B (PTL 1), which is "alloy-saving duplex stainless steel with good toughness and corrosion resistance in heat-affected zone, comprising a chemical composition containing, in mass %, C: 0.06% or less, Si: 0.1% to 1.5%, Mn: 2.0% to 4.0%, P: 0.05% or less, S: 0.005% or less, Cr: 19.0% to 23.0%, Ni: 1.0% to 4.0%, Mo: 1.0% or less, Cu: 0.1% to 3.0%, V: 0.05% to 0.5%, Al: 0.003% to 0.050%, O: 0.007% or less, N: 0.10% to 0.25%, and Ti: 0.05% or less, with the balance being Fe and inevitable impurities, wherein a Md30 value represented by the formula <1> is 80 or less, and Ni-bal. represented by the formula <2> is −8 or more and −4 or less, the relationship between Ni-bal. and N content satisfies the formula <3>, an austenite-phase area ratio is 40% to 70%, and 2×Ni+Cu is 3.5 or more, wherein $$Md30=551-462\times(C+N)-9.2\times Si-8.1\times Mn-29\times(Ni+Cu)-13.7\times Cr-18.5\times Mo-68\times Nb \quad <1>$$

$$Ni\text{-}bal.=(Ni+0.5Mn+0.5Cu+30C+30N)-1.1(Cr+1.5Si+Mo+W)+8.2 \quad <2>$$

$$N\ (\%)\leq 0.37+0.03\times(Ni\text{-}bal.) \quad <3>$$

where in the above formulas, the chemical symbol of each element represents the content of the element (%)."

CITATION LIST

Patent Literature

PTL 1: JP 5345070 B

SUMMARY

Technical Problem

SUS821L1 has excellent price stability because relatively inexpensive elements such as N, Mn and Cu are used as γ-phase forming elements instead of expensive Ni. Further, SUS821L1 has higher proof stress than SUS304.

Therefore, it is expected to apply the lean duplex stainless steel such as SUS821L1 to structural members to which SUS304 could not be applied due to its proof stress, such as structural members of underwater structures installed in water like dams, sluice gates, and water treatment equipment (hereinafter also referred to as "structural members of underwater structures").

In the environment where the underwater structures are installed, corrosion caused by microorganisms in water (hereinafter also referred to as "microbial corrosion") may occur. As used herein, microbial corrosion is corrosion that occurs when microorganisms adhere to the surface of a steel sheet, which is a phenomenon that corrosion of the steel sheet is accelerated on the underside (steel sheet side) of the adhered microorganisms.

However, conventional lean duplex stainless steel, including the duplex stainless steel of PTL 1, did not have sufficient microbial corrosion resistance to be used in the underwater environment described above, particularly for a welded portion of the stainless steels. This has been a problem in applying the lean duplex stainless steel to the structural members of underwater structures.

To solve the problem, it could thus be helpful to provide an austenitic-ferritic duplex stainless steel sheet having both high proof stress and excellent microbial corrosion resistance required for use in structural members of underwater structures.

The term "high proof stress" means that the 0.2% proof stress measured by a tensile test in accordance with JIS Z 2241 is 400 MPa or more.

The term "excellent microbial corrosion resistance" means that the antibacterial activity against *Staphylococcus aureus*, which is measured by an antibacterial test in accordance with JIS Z 2801, is 2.0 or more.

The term "particularly excellent microbial corrosion resistance" means that the antibacterial activity against *Staphylococcus aureus* and the antibacterial activity against *Escherichia coli*, which are measured by an antibacterial test in accordance with JIS Z 2801, are both 2.0 or more.

The term "still more excellent microbial corrosion resistance" means that the antibacterial activity against *Staphylococcus aureus* and the antibacterial activity against *Escherichia coli*, which are measured by an antibacterial test in accordance with JIS Z 2801, are both 2.0 or more, and that the number of gap-shaped test pieces with biofilm adhered to the gap is one or less in the biofilm adhesion resistance test described later.

Solution to Problem

We conducted various studies to solve the above problem and discovered the following.

(1) The main cause of microbial corrosion is considered to be adhesion of biofilm to the surface of an austenitic-ferritic duplex stainless steel sheet (hereinafter also referred to as "duplex stainless steel sheet"). Biofilm is used to express microbial communities, biological films, slime, and the like, whose formation actions and effects are still not fully understood. However, in view of the occurrence of microbial corrosion, the adhesion of biofilm to the surface of a duplex stainless steel sheet is considered to be the main cause of microbial corrosion.

(2) Therefore, we thought that preventing biofilm from adhering to the surface of a duplex stainless steel sheet may suppress microbial corrosion, and we further studied a method.

As a result, we discovered the following.

By improving the antibacterial properties of a duplex stainless steel sheet, specifically, by increasing the antibacterial activity against *Staphylococcus aureus* measured by an antibacterial test in accordance with HS Z 2801 to 2.0 or more, the adhesion of biofilm to the surface of the duplex stainless steel sheet is suppressed. This significantly improves the microbial corrosion resistance.

For that purpose, it is optimal to contain a predetermined amount of Ag in the chemical composition of the duplex stainless steel sheet. As a result, the adhesion of biofilm to the surface of the duplex stainless steel sheet can be suppressed and the microbial corrosion resistance can be improved while ensuring the high proof stress required for use in structural members of underwater structures.

(3) However, when the duplex stainless steel sheet is produced with Ag contained in the chemical composition, cracks in an edge of the steel sheet starting from the interface between a ferrite phase and an austenite phase (hereinafter also referred to as "edge cracking") frequently occurs in a hot rolling process during the production, and the producing efficiency and the yield rate are greatly reduced.

That is, most Ag is in an undissolved state and is located at crystal grain boundaries or inside the grains in a slab because the amount of solute Ag in steel (solubility limit) is small. The melting point of Ag (about 960° C.) is much lower than the melting point of the stainless steel which is the matrix. Therefore, Ag melts in the steel and becomes a liquid phase in a hot rolling process at a temperature higher than 1000° C. In duplex stainless steel, the hot workability of the ferrite phase and the hot workability of the austenite phases are different. Therefore, when Ag in liquid phase is present near the interface between the ferrite phase and the austenite phase, it serves as an initiation point of voids, which promotes edge cracking in the duplex stainless steel sheet. As a result, edge cracking occurs frequently in the hot rolling process.

(4) In this regard, we have further made various examinations and discovered the following.

That is, it is effective to contain an appropriate amount of B and/or REM according to the Ag content. In this way, it is possible to simultaneously achieve high proof stress and excellent microbial corrosion resistance, which are required for use in structural members of underwater structures, while suppressing the edge cracking.

(5) Although it is not necessarily clear why edge cracking in a duplex stainless steel sheet is suppressed by containing an appropriate amount of B and/or REM in accordance with the Ag content, we consider the reason as follows.

As described above, when Ag in liquid phase is present near the interface between a ferrite phase and an austenite phase (that is, at crystal grain boundaries where ferrite grains and austenite grains contact), it promotes edge cracking in the duplex stainless steel sheet. Here, B and REM segregate at the crystal grain boundaries preferentially over Ag, which suppresses the segregation of Ag to the crystal grain boundaries. As a result, voids caused by Ag in liquid phase near the interface between a ferrite phase and an austenite phase are less likely to occur, and the occurrence of edge cracking in the hot rolling process is suppressed.

The present disclosure is based on these discoveries and further studies.

We thus provide the following.

1. An austenitic-ferritic duplex stainless steel sheet, comprising a chemical composition containing (consisting of), in mass %, C: 0.100% or less,
Si: 1.00% or less,
Mn: 2.0% to 7.0%,
P: 0.07% or less,
S: 0.030% or less,
Cr: 18.0% to 24.0%,
Ni: 0.1% to 3.0%,
Mo: 0.01% to 1.00%,
Cu: 0.1% to 3.0%,
Ag: 0.010% to 0.120%, and
N: 0.15% to 0.30%, and
at least one selected from the group consisting of
B: 0.0010% to 0.0100%, and
REM: 0.010% to 0.100%,
with the balance consisting of Fe and inevitable impurities, wherein
the austenitic-ferritic duplex stainless steel sheet satisfies the following formula (1), $$(30\times[\%\ B]+1.2\times[\%\ REM])/[\%\ Ag]\geq 1.00 \quad (1)$$

where [% Ag], [% B] and [% REM] are the contents in mass % of Ag, B and REM in the chemical composition, respectively.

2. The austenitic-ferritic duplex stainless steel sheet according to 1., wherein the chemical composition further contains, in mass %, at least one selected from the group consisting of Al: 0.100% or less,
Ca: 0.0100% or less,
Mg: 0.0100% or less,
Ta: 0.10% or less,
Ti: 0.50% or less,
Nb: 0.50% or less,
Zr: 0.50% or less, and
V: 0.50% or less, 3. The austenitic-ferritic duplex stainless steel sheet according to 1. or 2., which is used for an underwater environment.

Advantageous Effect

According to the present disclosure, it is possible to obtain an austenitic-ferritic duplex stainless steel sheet that has both high proof stress and excellent microbial corrosion resistance and that can be produced with high productivity.

Because the austenitic-ferritic duplex stainless steel sheet of the present disclosure has both high proof stress and excellent microbial corrosion resistance, it is particularly advantageous when applied to structural members of underwater structures such as dams, sluice gates, and water treatment equipment.

DETAILED DESCRIPTION

The present disclosure will be described based on the following embodiment.

Figure 1:
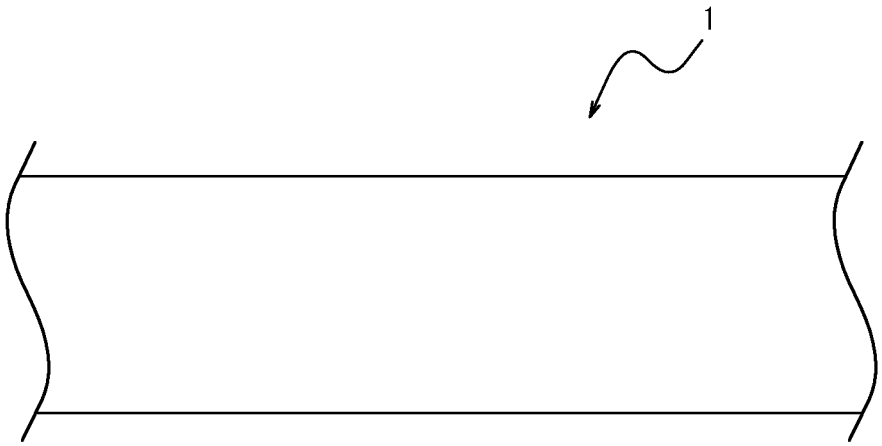
FIG. 1 schematically illustrates an austenitic-ferritic duplex stainless steel sheet of one embodiment of the present disclosure.

First, the chemical composition of an austenitic-ferritic duplex stainless steel sheet of one embodiment of the present disclosure (see FIG. 1, where reference sign 1 is an austenitic-ferritic duplex stainless steel sheet) will be described. The % representations below indicating the chemical composition are in mass % unless stated otherwise.

C: 0.100% or less

C is an element that increases the austenite phase (hereinafter also referred to as "γ phase") fraction. To obtain this effect, the C content is preferably set to 0.003% or more. On the other hand, when the C content exceeds 0.100%, the heat treatment temperature for dissolving C increases, which reduces the productivity. Therefore, the C content is set to 0.100% or less. The C content is preferably less than 0.050%, more preferably less than 0.030%, and still more preferably less than 0.020%.

Si: 1.00% or less

Si is an element used as a deoxidizer. To obtain this effect, the Si content is preferably set to 0.01% or more. On the other hand, when the Si content exceeds 1.00%, the strength of the steel material is excessively increased, and the cold workability is deteriorated. In addition, Si is an element that forms the ferrite phase (hereinafter also referred to as "α-phase"), so that it may be difficult to obtain the desired γ-phase fraction if the Si content exceeds 1.00%. Therefore, the Si content is set to 1.00% or less. The Si content is preferably 0.70% or less, more preferably 0.50% or less, and still more preferably 0.35% or less.

Mn: 2.0% to 7.0%

Mn is an element that increases the amount of solute N in the α-phase, prevents sensitization at α-phase grain boundaries, and suppresses blowholes during welding. To obtain these effects, the Mn content is set to 2.0% or more. On the other hand, when the Mn content exceeds 7.0%, the hot workability and the corrosion resistance are deteriorated. Therefore, the Mn content is set to 2.0% to 7.0%. The Mn content is preferably 2.5% or more. The Mn content is preferably 5.0% or less, more preferably 4.0% or less, and still more preferably 3.5% or less.

P: 0.07% or less

P is an element that deteriorates corrosion resistance and hot workability. When the P content exceeds 0.07%, the corrosion resistance and the hot workability significantly deteriorate. Therefore, the P content is set to 0.07% or less. The P content is preferably 0.05% or less and more preferably 0.04% or less. The lower limit of the P content is not particularly limited, but excessive dephosphorization leads to an increase in costs. Therefore, the P content is preferably set to 0.01% or more.

S: 0.030% or less

S is an element that deteriorates corrosion resistance and hot workability. When the S content exceeds 0.030%, the corrosion resistance and the hot workability significantly deteriorate. Therefore, the S content is set to 0.030% or less. The S content is preferably 0.010% or less and more preferably 0.005% or less. The lower limit of the S content is not particularly limited, but excessive desulfurization leads to an increase in costs. Therefore, the S content is preferably set to 0.0001% or more.

Cr: 18.0% to 24.0%

Cr is an important element for ensuring the corrosion resistance of stainless steel. When the Cr content is less than 18.0%, sufficient corrosion resistance cannot be obtained. On the other hand, Cr is an element that forms the α-phase. When the Cr content exceeds 24.0%, it is difficult to obtain enough γ-phase fraction. Therefore, the Cr content is set to 18.0% to 24.0%. The Cr content is preferably 19.0% or more and more preferably 20.5% or more. The Cr content is preferably 23.0% or less and more preferably 22.0% or less.

Ni: 0.1% to 3.0%

Ni is an element that forms the γ-phase and has the effect of improving crevice corrosion resistance. Further, the addition of Ni to duplex stainless steel improves the corrosion resistance of the ferrite phase and increases the pitting corrosion potential. To obtain these effects, the Ni content is set to 0.1% or more. On the other hand, when the Ni content exceeds 3.0%, the amount of Ni in the α-phase increases, resulting in deterioration in the ductility of the α-phase and thus deterioration in the formability. Further, Ni is an expensive element whose price fluctuates rapidly, so that the price stability of the steel sheet is impaired if the Ni content increases. Therefore, the Ni content is set to 0.1% to 3.0%. The Ni content is preferably 0.5% or more and more preferably 1.5% or more. The Ni content is preferably 2.5% or less.

Mo: 0.01% to 1.00%

Mo has the effect of improving corrosion resistance. To obtain this effect, the Mo content is set to 0.01% or more. On the other hand, when the Mo content exceeds 1.00%, the high-temperature strength increases, and the hot workability deteriorates. Further, Mo is an expensive element whose price fluctuates rapidly, so that the price stability of the steel sheet is impaired if the Mo content increases. Therefore, the Mo content is set to 0.01% to 1.00%. The Mo content is preferably 0.10% or more and more preferably 0.20% or more. The Mo content is preferably 0.60% or less and more preferably 0.40% or less.

Cu: 0.1% to 3.0%

Cu is an element that forms the γ-phase and has the effect of increasing the γ-phase fraction. To obtain these effects, the Cu content is set to 0.1% or more. On the other hand, when the Cu content exceeds 3.0%, the high-temperature strength increases, and the hot workability deteriorates. Therefore, the Cu content is set to 0.1% to 3.0%. The Cu content is preferably 0.2% or more, more preferably 0.3% or more, and still more preferably 0.5% or more. The Cu content is preferably 1.5% or less and more preferably 1.2% or less.

Ag: 0.010% to 0.120%

Ag is an important element that improves microbial corrosion resistance. To obtain this effect, the Ag content is set to 0.010% or more. It is preferably 0.040% or more. On the other hand, most Ag is in an undissolved state and is located at crystal grain boundaries or inside the grains in a slab because the amount of solute Ag in steel (solubility limit) is small. Because the melting point of Ag (about 960° C.) is much lower than that of stainless steel, Ag melts in the steel and becomes a liquid phase during a hot rolling process at a temperature higher than 1000° C. In duplex stainless steel, the hot workability of the ferrite phase and the hot workability of the austenite phases are different. Therefore, when Ag in liquid phase is present near the interface between the ferrite phase and the austenite phase (that is, at crystal grain boundaries where ferrite grains and austenite grains contact), it serves as an initiation point of voids, which promotes edge cracking in the duplex stainless steel. As a result, edge cracking occurs frequently in the hot rolling process. Particularly when the Ag content is more than 0.120%, there is too much undissolved Ag located at crystal grain boundaries and inside the grains in a slab. This makes it impossible to achieve both excellent microbial corrosion resistance and suppression of edge cracking even if REM and B, which will be described later, are contained in the steel. Therefore, the Ag content is set to 0.010% to 0.120%. The Ag content is preferably 0.100% or less and more preferably 0.080% or less.

N: 0.15% to 0.30%

N is an element that forms the γ-phase and is also an element that improves corrosion resistance and strength. To obtain these effects, the N content is set to 0.15% or more. On the other hand, when the N content exceeds 0.30%, the excess N causes blowholes during casting and welding. Therefore, the N content is set to 0.15% to 0.30%. The N content is preferably 0.17% or more. The N content is preferably 0.25% or less and more preferably 0.20% or less.

It is extremely important for the duplex stainless steel sheet of one embodiment of the present disclosure to contain, in addition to Ag: 0.010% to 0.120% as described above, at least one selected from the group consisting of B: 0.0010% to 0.0100% and REM: 0.010% to 0.100% or less, where the Ag content, B content and REM content satisfy the following formula (1):

$$(30\times[\%\ B]+1.2\times[\%\ REM])/[\%\ Ag]\geq 1.00 \quad (1)$$

where [% Ag], [% B] and [% REM] are the contents (mass %) of Ag, B and REM in the chemical composition, respectively.

That is, B and REM are effective in preventing edge cracking during hot rolling, which is promoted by Ag. However, excessive B and REM contents lead to deterioration in corrosion resistance.

In this regard, we have made various examinations and found the following.

That is, it is important to contain an appropriate amount of B and/or REM according to the content of Ag, specifically, it is important to contain at least one selected from the group consisting of B: 0.0010% to 0.0100% (preferably, 0.0010% to 0.0050%) and REM: 0.010% to 0.100% (preferably, 0.010% to 0.070%) and to satisfy the above formula (1). In this way, it is possible to simultaneously achieve high proof stress and excellent microbial corrosion resistance, which are required for use in structural members of underwater structures, while effectively suppressing the edge cracking during hot rolling.

Therefore, the duplex stainless steel sheet of one embodiment of the present disclosure contains at least one selected from the group consisting of B: 0.0010% to 0.0100% and REM: 0.010% to 0.100% or less, where the Ag content, B content and REM content satisfy the above formula (1).

For the above formula (1), the value of (30×[% B]+1.2×[% REM])/[% Ag] is preferably 2.00 or more, as in the following formula. This can more effectively suppress the edge cracking during hot rolling.

$$(30\times[\%\ B]+1.2\times[\%\ REM])/[\%\ Ag]\geq 2.00$$

The term "REM" refers to Sc, Y and lanthanide elements (elements with atomic numbers from 57 to 71 such as La, Ce, Pr, Nd, and Sm), and the REM content here is a total content of these elements.

Basic components have been described above. In addition to the above basic components, the chemical composition may further appropriately contain at least one selected from the group consisting of Al: 0.100% or less,
Ca: 0.0100% or less,
Mg: 0.0100% or less,
Ta: 0.10% or less,
Ti: 0.50% or less,
Nb: 0.50% or less,
Zr: 0.50% or less, and
V: 0.50% or less.

Al: 0.100% or less

Al is an element used as a deoxidizer. To obtain this effect, the Al content is preferably set to 0.010% or more. It is more preferably 0.015% or more and still more preferably 0.020% or more. However, when the Al content exceeds 0.100%, nitrides may be formed and cause surface defects. Therefore, when Al is contained, its content is set to 0.100% or less. The Al content is preferably 0.080% or less and more preferably 0.050% or less.

Ca: 0.0100% or less and Mg: 0.0100% or less

Both Ca and Mg are elements that improve hot workability. To obtain this effect, it is preferable to set the Ca content and the Mg content to 0.0003% or more, respectively. On the other hand, when the Ca content and the Mg content each exceed 0.0100%, the corrosion resistance may deteriorate. Therefore, when Ca and Mg are contained, the Ca content and the Mg content are set to 0.0100% or less, respectively. The Ca content and the Mg content are preferably 0.0050% or less, respectively.

Ta: 0.10% or less

Ta, like Ca and Mg, is also an element that improves hot workability. To obtain this effect, the Ta content is preferably set to 0.005% or more. On the other hand, when the Ta content exceeds 0.10%, the corrosion resistance may deteriorate. Therefore, when Ta is contained, its content is set to 0.10% or less. The Ta content is preferably 0.05% or less.

Ti: 0.50% or less

Ti has the effects of improving the strength of steel and fixing C and N in steel to improve the corrosion resistance of a welded portion. To obtain these effects, the Ti content is preferably 0.01% or more. The Ti content is more preferably 0.03% or more and still more preferably 0.05% or more. On the other hand, when the Ti content exceeds 0.50%, the above effects are saturated. In addition, Ti-containing inclusions may cause surface defects. Further, it leads to an increase in alloy costs. Therefore, when Ti is contained, the Ti content is set to 0.50% or less. The Ti content is preferably 0.20% or less and more preferably 0.10% or less.

Nb: 0.50% or less

Nb, like Ti, has the effects of improving the strength of steel and fixing C and N in steel to improve the corrosion resistance of a welded portion. To obtain these effects, the Nb content is preferably 0.01% or more. The Nb content is more preferably 0.03% or more and still more preferably 0.05% or more. On the other hand, when the Nb content exceeds 0.50%, the above effects are saturated. In addition, Nb-containing inclusions may cause surface defects. Further, it leads to an increase in alloy costs. Therefore, when Nb is contained, the Nb content is set to 0.50% or less. The Nb content is preferably 0.20% or less and more preferably 0.10% or less.

Zr: 0.50% or less

Zr, like Ti, has the effects of improving the strength of steel and fixing C and N in steel to improve the corrosion resistance of a welded portion. To obtain these effects, the Zr content is preferably 0.01% or more. The Zr content is more preferably 0.03% or more and still more preferably 0.05% or more. On the other hand, when the Zr content exceeds 0.50%, the above effects are saturated. In addition, Zr-containing inclusions may cause surface defects. Further, it leads to an increase in alloy costs. Therefore, when Zr is contained, the Zr content is set to 0.50% or less. The Zr content is preferably 0.20% or less and more preferably 0.10% or less.

V: 0.50% or less

V, like Ti, has the effects of improving the strength of steel and fixing C and N in steel to improve the corrosion resistance of a welded portion. To obtain these effects, the V content is preferably 0.01% or more. The V content is more preferably 0.03% or more and still more preferably 0.05% or more. On the other hand, when the V content exceeds 0.50%, the above effects are saturated. In addition, V-containing inclusions may cause surface defects. Further, it leads to an increase in alloy costs. Therefore, when V is contained, the V content is set to 0.50% or less. The V content is preferably 0.20% or less and more preferably 0.10% or less.

The components other than those described above are Fe and inevitable impurities.

Examples of the inevitable impurities include O (oxygen). O (oxygen) is preferably 0.05% or less from the viewpoint of preventing surface defects caused by inclusion.

Next, the microstructure of the austenitic-ferritic duplex stainless steel sheet of one embodiment of the present disclosure will be described.

The microstructure of the austenitic-ferritic duplex stainless steel sheet of one embodiment of the present disclosure contains an austenite phase and a ferrite phase.

The volume fraction of the austenite phase is preferably 30% or more and 70% or less, and the volume fraction of the ferrite phase is preferably 30% or more and 70% or less.

The microstructure of the austenitic-ferritic duplex stainless steel sheet of one embodiment of the present disclosure may consist of only two phases of an austenite phase and a ferrite phase, or it may contain precipitates of 1% or less by volume as the balance other than the austenite phase and the ferrite phase. Examples of the precipitates include at least one selected from the group consisting of intermetallic compounds, carbides, nitrides, and sulfides.

The volume fractions of the ferrite phase and the austenite phases are determined as follows.

That is, a test piece of a length of 15 mm and a width of 10 mm is collected from the steel sheet as a sample, the test piece is embedded in resin so that a cross section parallel to the rolling direction is an observation plane, and the cross section is mirror polished. Next, the test piece is subjected to color treatment with Murakami's reagent (an aqueous solution in which 10 g of potassium ferricyanide, 10 g of potassium hydroxide and 100 $cm^3$ of pure water are mixed) and then observed under an optical microscopy.

In the coloring process with Murakami's reagent, only the ferrite phase is colored gray (the surface is etched so that it reflects light diffusely; as a result, the ferrite phase is darker than the part of austenite phase and appears to be colored gray), whereas the austenite phase remains white without being colored (the surface is not etched and is still a mirror-polished surface, which is bright). This reaction is used to distinguish the austenite phase from the ferrite phase, and then the area ratio of the austenite phase is calculated by image analysis. The observation is carried out in five locations at a magnification of 200 times, and the average value of the area ratios is used as the volume ratio of the austenite phase.

Further, the volume fraction of the ferrite phase is determined as follows.

[Volume fraction of ferrite phase (%)]=100−[volume fraction of austenite phase (%)]

In a case where precipitates are observed, the volume fraction of the ferrite phase is obtained by further subtracting the total volume fraction of precipitates from the right-hand side of the above equation.

The thickness of the austenitic-ferritic duplex stainless steel sheet of one embodiment of the present disclosure is not particularly limited, but it is preferably 0.3 mm to 40 mm. It is more preferably 1.0 mm to 30 mm.

Next, a suitable method of producing the austenitic-ferritic duplex stainless steel sheet of one embodiment of the present disclosure will be described.

Molten steel with the above chemical composition is obtained by steelmaking in a converter or electric furnace, refined by vacuum oxygen decarburization (VOD) or argon oxygen decarburization (AOD), and then made into a slab by blooming or continuous casting.

The slab is then heated to 1200° C. to 1300° C. and subjected to hot rolling to obtain a hot-rolled steel sheet (including so-called steel plate).

The obtained hot-rolled steel sheet is preferably subjected to annealing at 900° C. to 1200° C. and then descaled by pickling or polishing or the like, if necessary. In the pickling, sulfuric acid or a mixture of nitric acid and hydrofluoric acid can be used, for example. If necessary, scales may be removed by shot blasting before the pickling.

Next, the obtained hot-rolled steel sheet may be subjected to annealing and cold rolling to obtain a cold-rolled steel sheet.

The obtained cold-rolled steel sheet is preferably subjected to continuous annealing at a temperature of 900° C. to 1200° C. and then descaled by pickling or polishing or the like, if necessary. Further, bright annealing may be performed at a temperature of 900° C. to 1200° C., if necessary.

EXAMPLES

Example 1

A steel ingot having a length of 300 mm, a width of 150 mm and a thickness of 150 mm with the chemical composition listed in Table 1 (the balance being Fe and inevitable impurities) was obtained by steelmaking in a vacuum melting furnace, and the steel ingot was heated to 1250° C. and then subjected to hot rolling to obtain a sheet bar having a thickness of 30 mm.

The sheet bar was cut into a length of 200 mm and heated to 1250° C. again and then subjected to hot rolling to obtain a hot-rolled steel sheet having a thickness of 4.0 mm. The obtained hot-rolled steel sheet was used to evaluate the edge cracking resistance during hot rolling with the following method.

(1) Evaluation of Edge Cracking Resistance During Hot Rolling

A test piece having a length of 200 mm was collected from the hot-rolled steel sheet thus obtained so that the center of the hot-rolled steel sheet in the longitudinal direction was the center of the test piece in the longitudinal direction. In the collected test piece, the length of edge cracks from an edge toward the center in the width direction of the sheet was measured. Among all the edge cracks that occurred in the test piece, the length of a crack that extended the longest toward the center in the width direction of the sheet was defined as "maximum crack length". The maximum crack length was used to evaluate the edge cracking resistance during hot rolling based on the following criteria. The evaluation results are listed in Table 2.

Passed, particularly excellent: the maximum crack length was 10 mm or less

Passed, excellent: the maximum crack length was more than 10 mm and 20 mm or less Rejected: the maximum crack length was more than 20 mm.

Next, the obtained hot-rolled steel sheet was cut into a length of 200 mm and annealed at 1100° C. for one minute in the air, and then surface scales were removed by shot blasting and grinder to obtain a hot-rolled annealed steel sheet.

Next, the obtained hot-rolled annealed steel sheet was subjected to cold rolling and annealed at 1100° C. for one minute in the air, and then the surface was polished with #240 abrasive paper to remove scales to obtain a cold-rolled annealed steel sheet having a thickness of 1.0 mm.

Next, the proof stress and the microbial corrosion resistance were evaluated with the following method.

(2) Evaluation of Proof Stress

No. 5 tensile test pieces were collected from the cold-rolled annealed steel sheet thus obtained in accordance with JIS Z 2241, and 0.2% proof stress was measured. The number of test pieces was two for each steel sheet, and the arithmetic mean value was used as the 0.2% proof stress of the steel sheet. The proof stress was evaluated based on the following criteria. The evaluation results are also listed in Table 2.

Passed: the 0.2% proof stress was 400 MPa or more

Rejected: the 0.2% proof stress was less than 400 MPa (3) Evaluation of Microbial Corrosion Resistance A test piece having a length (rolling direction) of 350 mm and a width of 50 mm was collected from the cold-rolled annealed steel sheet thus obtained, and TIG welding was performed on the central portion of the width of the test piece with a bead-on plate method to prepare a welded test piece. The welding direction was the longitudinal direction of the test piece, the welding length was 330 mm, the welding current was 110 A, the welding speed was 600 mm/min, Ar shielding gas was used on both sides, and no weld wire was used. The weld bead width was about 4 mm.

Six test pieces for evaluation having a length of 50 mm and a width of 50 mm were collected from the prepared welded test piece so that the welding direction was parallel to the longitudinal direction of the test piece for evaluation and the weld bead was located at the center in the width direction of the test piece for evaluation. A part of 15 mm from the start and the end of the welded portion in the welding direction (longitudinal direction) was cut, respectively. Next, the test surface (the surface on the front side (the surface on the side of welding torch during welding)) of the test pieces for evaluation was polished with #600 abrasive paper.

The test pieces for evaluation were prepared for the following (a) antibacterial activity measurement and (b) biofilm adhesion resistance test, respectively (6 pieces×2), and the (a) antibacterial activity measurement and the (b) biofilm adhesion resistance test were conducted with the following methods.

(a) Antibacterial Activity Measurement

An antibacterial test was performed according to JIS Z 2801 using the polished test pieces for evaluation, and the antibacterial activity against *Staphylococcus aureus* and the antibacterial activity against *Escherichia coli* were measured. The respective antibacterial activity was determined by the following formula (2) in accordance with JIS Z 2801.

$$R=(U_t-U_0)-(A_t-U_0)=U_t-A_t \quad \text{formula (2)}$$

R: Antibacterial activity $U_0$: Mean value of the logarithm of the number of viable bacteria immediately after inoculation of an unprocessed test piece $U_t$: Mean value of the logarithm of the number of viable bacteria after 24 hours for the unprocessed test piece $A_t$: Mean value of the logarithm of the number of viable bacteria after 24 hours for a test piece for evaluation Polyethylene film was used for the unprocessed test piece. The antibacterial activity against the test solutions of *Staphylococcus aureus* and *Escherichia coli* was determined using three test pieces for evaluation, respectively, and the average value of the three test pieces was used as the antibacterial activity against *Staphylococcus aureus* and the antibacterial activity against *Escherichia coli*, respectively.

Next, evaluation was performed based on the following criteria. The evaluation results are also listed in Table 2.

Passed, particularly excellent: the antibacterial activity against *Staphylococcus aureus* and the antibacterial activity against *Escherichia coli* were both 2.0 or more Passed, excellent: the antibacterial activity against *Staphylococcus aureus* was 2.0 or more (excluding those of "passed, particularly excellent")

Rejected: the antibacterial activity against *Staphylococcus aureus* was less than 2.0

(b) Biofilm Adhesion Resistance Test

Figure 2:
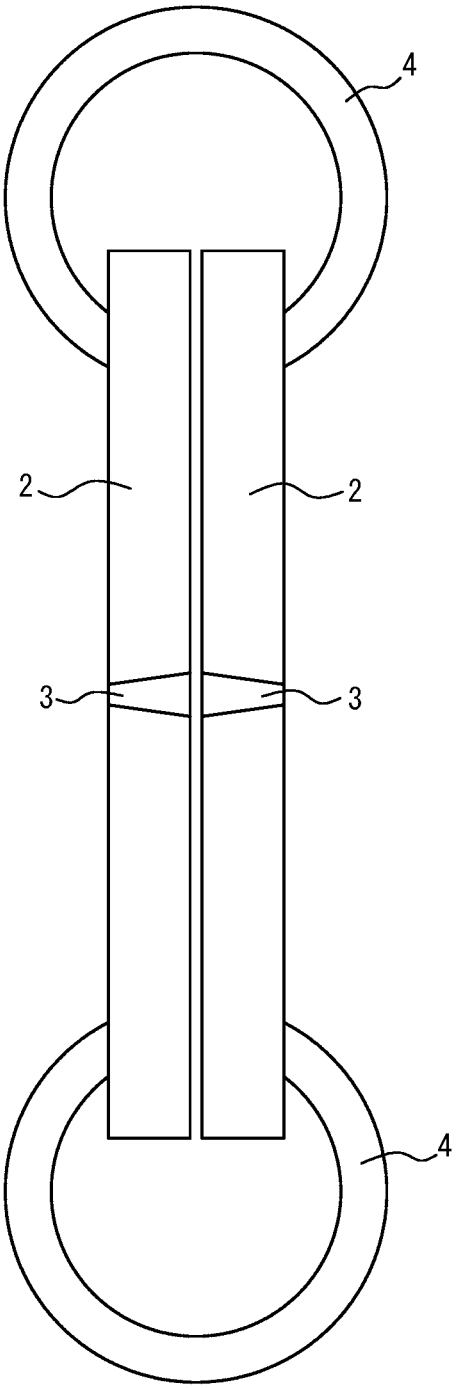
FIG. 2 schematically illustrates a gap-shaped test piece used for a biofilm adhesion resistance test.

Using the polished test pieces for evaluation, three test pieces with a gap between the test surfaces as illustrated in FIG. 2 (hereinafter also referred to as "gap-shaped test piece") were prepared. In FIG. 2, reference sign 2 is a test piece for evaluation, reference sign 3 is weld bead, and reference sign 4 is a silicon tube.

That is, two test pieces for evaluation were overlapped so that the test surfaces were in contact with each other. The two overlapped test pieces for evaluation were fixed by a silicon tube with a cut in it to obtain a gap-shaped test piece.

The prepared gap-shaped test pieces were immersed in water collected from a dam lake in Chiba Prefecture (hereinafter also referred to as "collected water") for 120 days. After immersion, the gap-shaped test pieces were dismantled to visually check the formation (adhesion) of biofilm (cloudy adhesion like a thin film) in the gap. The immersion was performed in a sealed glass container, and the three gap-shaped test pieces were placed in 550 ml of the collected water at a temperature of 50° C. The collected water was not changed or replenished during the immersion.

The microbial corrosion resistance was evaluated based on the following criteria. The results are also listed in Table 2.

Passed, particularly excellent: no biofilm was observed in the gap in all of the three gap-shaped test pieces Passed, excellent: biofilm was adhered in the gap of one gap-shaped test piece Rejected: biofilm was adhered in the gap of two or more gap-shaped test pieces When the microstructure of the cold-rolled annealed steel sheets thus obtained was observed with the above-described method, it was found that the microstructure of any of the cold-rolled annealed steel sheets was composed of only two phases of an austenite phase and a ferrite phase, where the volume fraction of the austenite phase was in a range of 30% or more and 70% or less, and the volume fraction of the ferrite phase was in a range of 30% or more and 70% or less.

TABLE 1

| No. | Chemical composition (mass %) C | Si | Mn | P | S | Cr | Ni | Mo | Cu | Ag | N | B | REM | Others | Left value of formula (1) | Remarks |
|---|---|---|---|---|---|---|---|---|---|---|---|---|---|---|---|---|
| 1 | 0.016 | 0.29 | 3.0 | 0.03 | 0.002 | 20.8 | 2.0 | 0.31 | 1.0 | 0.019 | 0.17 | — | 0.032 | — | 2.02 | Example |
| 2 | 0.013 | 0.32 | 3.0 | 0.03 | 0.001 | 21.0 | 2.0 | 0.31 | 1.0 | 0.027 | 0.17 | 0.0031 | 0.029 | — | 4.73 | Example |
| 3 | 0.015 | 0.29 | 3.0 | 0.03 | 0.001 | 20.9 | 2.0 | 0.30 | 1.0 | 0.053 | 0.18 | 0.0028 | — | — | 1.58 | Example |
| 4 | 0.018 | 0.30 | 3.0 | 0.03 | 0.001 | 21.1 | 2.1 | 0.31 | 1.0 | 0.041 | 0.17 | — | 0.043 | Ca: 0.0033<br>Mg: 0.0028 | 1.26 | Example |
| 5 | 0.019 | 0.31 | 3.0 | 0.03 | 0.002 | 20.9 | 2.0 | 0.30 | 1.0 | 0.031 | 0.17 | — | 0.036 | Al: 0.030<br>Ta: 0.03 | 1.39 | Example |
| 6 | 0.015 | 0.30 | 3.0 | 0.03 | 0.001 | 21.2 | 2.0 | 0.31 | 1.0 | 0.045 | 0.18 | 0.0028 | 0.025 | Ti: 0.12 | 2.53 | Example |
| 7 | 0.016 | 0.31 | 3.0 | 0.03 | 0.002 | 20.1 | 2.0 | 0.30 | 1.0 | 0.051 | 0.17 | — | 0.055 | Nb: 0.10 | 1.29 | Example |
| 8 | 0.014 | 0.29 | 2.9 | 0.04 | 0.001 | 20.9 | 2.1 | 0.29 | 1.0 | 0.058 | 0.17 | 0.0028 | — | V: 0.11 | 1.45 | Example |
| 9 | 0.015 | 0.30 | 2.9 | 0.03 | 0.002 | 21.2 | 2.0 | 0.30 | 1.0 | 0.029 | 0.18 | — | 0.056 | Zr: 0.09 | 2.32 | Example |
| 10 | 0.016 | 0.29 | 3.0 | 0.03 | 0.002 | 21.1 | 2.0 | 0.30 | 1.0 | 0.048 | 0.17 | 0.0081 | — | — | 5.06 | Example |
| 11 | 0.017 | 0.31 | 3.1 | 0.04 | 0.003 | 20.2 | 2.0 | 0.31 | 1.0 | 0.025 | 0.17 | 0.0012 | — | — | 1.44 | Example |
| 12 | 0.018 | 0.28 | 2.9 | 0.03 | 0.002 | 20.1 | 2.1 | 0.32 | 1.0 | 0.033 | 0.17 | — | 0.092 | — | 3.35 | Example |
| 13 | 0.017 | 0.30 | 3.0 | 0.03 | 0.002 | 20.2 | 2.0 | 0.32 | 1.0 | 0.034 | 0.18 | — | 0.012 | — | 0.42 | Comparative example |
| 14 | 0.015 | 0.31 | 3.1 | 0.03 | 0.002 | 21.1 | 2.1 | 0.31 | 1.0 | 0.054 | 0.18 | 0.0014 | — | — | 0.78 | Comparative example |
| 15 | 0.015 | 0.30 | 3.0 | 0.03 | 0.001 | 20.9 | 2.0 | 0.30 | 1.0 | 0.092 | 0.17 | 0.0022 | 0.017 | — | 0.94 | Comparative example |
| 16 | 0.016 | 0.28 | 2.9 | 0.04 | 0.001 | 20.2 | 2.1 | 0.29 | 1.0 | 0.124 | 0.17 | 0.0024 | 0.054 | — | 1.10 | Comparative example |
| 17 | 0.016 | 0.30 | 3.0 | 0.03 | 0.001 | 20.9 | 2.1 | 0.31 | 1.0 | 0.132 | 0.18 | — | 0.049 | — | 0.45 | Comparative example |
| 18 | 0.015 | 0.31 | 3.1 | 0.04 | 0.002 | 21.0 | 2.0 | 0.31 | 1.0 | 0.029 | 0.17 | — | — | — | 0.00 | Comparative example |
| 19 | 0.015 | 0.28 | 3.0 | 0.03 | 0.001 | 20.6 | 2.0 | 0.31 | 1.0 | 0.005 | 0.17 | — | 0.031 | — | 7.44 | Comparative example |
| 20 | 0.015 | 0.28 | 3.0 | 0.03 | 0.001 | 20.7 | 2.1 | 0.31 | 1.0 | — | 0.17 | — | 0.035 | — | — | Comparative example |
| 21 | 0.016 | 0.33 | 2.5 | 0.03 | 0.001 | 21.3 | 2.8 | 0.05 | 0.4 | 0.023 | 0.18 | — | 0.031 | — | 1.62 | Example |
| 22 | 0.015 | 0.31 | 2.2 | 0.03 | 0.001 | 19.1 | 1.6 | 0.09 | 2.5 | 0.021 | 0.18 | 0.0031 | — | — | 4.43 | Example |
| 23 | 0.015 | 0.31 | 3.1 | 0.04 | 0.001 | 21.0 | 2.0 | 0.30 | 1.0 | 0.023 | 0.18 | 0.0007 | — | — | 0.91 | Comparative example |
| 24 | 0.016 | 0.29 | 3.0 | 0.03 | 0.002 | 21.1 | 2.0 | 0.29 | 1.0 | 0.032 | 0.17 | — | 0.008 | — | 0.30 | Comparative example |

TABLE 2

| No. | (1) Edge cracking resistance during hot rolling | (2) Proof stress 0.2% proof stress (MPa) | Evaluation | (3) Microbial corrosion resistance (a) Antibacterial activity measurement *Staphylococcus aureus* | *Escherichia coli* | Evaluation | (b) Biofilm adhesion resistance test Evaluation | Remarks |
|---|---|---|---|---|---|---|---|---|
| 1 | Passed, particularly excellent | 510 | Passed | 2.5 | 1.0 | Passed, excellent | Passed, excellent | Example |
| 2 | Passed, particularly excellent | 489 | Passed | 3.4 | 1.1 | Passed, excellent | Passed, excellent | Example |
| 3 | Passed, excellent | 508 | Passed | 4.0 | 3.0 | Passed, particularly excellent | Passed, particularly excellent | Example |
| 4 | Passed, excellent | 508 | Passed | 3.9 | 2.5 | Passed, particularly excellent | Passed, particularly excellent | Example |
| 5 | Passed, excellent | 489 | Passed | 3.2 | 1.8 | Passed, excellent | Passed, excellent | Example |
| 6 | Passed, particularly excellent | 488 | Passed | 4.2 | 2.2 | Passed, particularly excellent | Passed, particularly excellent | Example |
| 7 | Passed, excellent | 519 | Passed | 4.5 | 3.1 | Passed, particularly excellent | Passed, particularly excellent | Example |
| 8 | Passed, excellent | 518 | Passed | 4.3 | 4.0 | Passed, particularly excellent | Passed, particularly excellent | Example |
| 9 | Passed, particularly excellent | 521 | Passed | 3.1 | 1.9 | Passed, excellent | Passed, excellent | Example |
| 10 | Passed, particularly excellent | 511 | Passed | 4.0 | 2.9 | Passed, particularly excellent | Passed, particularly excellent | Example |
| 11 | Passed, excellent | 502 | Passed | 2.9 | 1.2 | Passed, excellent | Passed, excellent | Example |
| 12 | Passed, particularly excellent | 498 | Passed | 3.2 | 1.8 | Passed, excellent | Passed, excellent | Example |
| 13 | Rejected | 495 | Passed | 3.2 | 1.9 | Passed, excellent | Passed, excellent | Comparative example |
| 14 | Rejected | 498 | Passed | 4.3 | 4.7 | Passed, particularly excellent | Passed, particularly excellent | Comparative example |
| 15 | Rejected | 505 | Passed | 4.1 | 5.8 | Passed, particularly excellent | Passed, particularly excellent | Comparative example |
| 16 | Rejected | 501 | Passed | 4.8 | 5.4 | Passed, particularly excellent | Passed, particularly excellent | Comparative example |
| 17 | Rejected | 502 | Passed | 4.0 | 5.2 | Passed, particularly excellent | Passed, particularly excellent | Comparative example |
| 18 | Rejected | 511 | Passed | 3.5 | 1.2 | Passed, excellent | Passed, excellent | Comparative example |
| 19 | Passed, particularly excellent | 500 | Passed | 1.2 | 0.5 | Rejected | Rejected | Comparative example |

TABLE 2-continued

| No. | (1) Edge cracking resistance during hot rolling | (2) Proof stress 0.2% proof stress (MPa) | Evaluation | (3) Microbial corrosion resistance (a) Antibacterial activity measurement *Staphylococcus aureus* | *Escherichia coli* | Evaluation | (b) Biofilm adhesion resistance test Evaluation | Remarks |
|---|---|---|---|---|---|---|---|---|
| 20 | Passed, particularly excellent | 509 | Passed | 1.1 | 0.5 | Rejected | Rejected | Comparative example |
| 21 | Passed, particularly excellent | 500 | Passed | 3.5 | 1.3 | Passed, excellent | Passed, excellent | Example |
| 22 | Passed, particularly excellent | 509 | Passed | 3.2 | 1.4 | Passed, excellent | Passed, excellent | Example |
| 23 | Rejected | 515 | Passed | 3.3 | 1.3 | Passed, excellent | Passed, excellent | Comparative example |
| 24 | Rejected | 517 | Passed | 3.4 | 1.9 | Passed, excellent | Passed, excellent | Comparative example |

According to Table 2, all the Examples had both high proof stress and excellent microbial corrosion resistance, where the edge cracking during hot rolling was also effectively suppressed.

On the other hand, in the Comparative Examples, the microbial corrosion resistance was insufficient, or the edge cracking during hot rolling could not be effectively suppressed.

Example 2

A steel ingot having a length of 300 mm, a width of 150 mm and a thickness of 150 mm with the chemical composition listed in Table 1 (the balance being Fe and inevitable impurities) was obtained by steelmaking in a vacuum melting furnace, and the steel ingot was heated to 1250° C. and then subjected to hot rolling to obtain a sheet bar having a thickness of 30 mm.

Three pieces of the sheet bar cut to a length of 300 mm were collected, and the three pieces were heated to 1100° C. again and then subjected to hot rolling to obtain three hot-rolled steel sheets having a thickness of 12.0 mm. The obtained hot-rolled steel sheets were used to evaluate the edge cracking resistance during hot rolling with the following method.

(4) Evaluation of Edge Cracking Resistance During Hot Rolling

A test piece having a length of 200 mm was collected from one of the hot-rolled steel sheets thus obtained so that the center of the hot-rolled steel sheet in the longitudinal direction was the center of the test piece in the longitudinal direction. In the collected test piece, the length of edge cracks from an edge toward the center in the width direction of the sheet was measured. Among all the edge cracks that occurred in the test piece, the length of a crack that extended the longest toward the center in the width direction of the sheet was defined as "maximum crack length". The maximum crack length was used to evaluate the edge cracking resistance during hot rolling based on the following criteria. The evaluation results are also listed in Table 3.

Passed, particularly excellent: the maximum crack length was 6 mm or less

Pass, excellent: the maximum crack length was more than 6 mm and 12 mm or less

Rejected: the maximum crack length was more than 12 mm.

Next, the remaining two of the obtained hot-rolled steel sheets were annealed at 1100° C. for 30 minutes in the air and then subjected to water cooling. Further, the surface of the hot-rolled steel sheets was ground by shot blasting and grinder to remove surface scales, and hot-rolled annealed steel sheets having a thickness of 10.0 mm were obtained.

Next, the proof stress and the microbial corrosion resistance were evaluated with the following method.

(5) Evaluation of Proof Stress

No. 14A tensile test pieces (diameter of parallel portion: 6 mm, gauge length: 42 mm) were collected from the hot-rolled annealed steel sheets thus obtained in accordance with JIS Z 2241, and 0.2% proof stress was measured. The tensile direction was parallel to the rolling direction. The number of test pieces was two for each steel sheet, and the arithmetic mean value was used as the 0.2% proof stress of the steel sheet. The proof stress was evaluated based on the following criteria. The evaluation results are also listed in Table 3.

Passed: the 0.2% proof stress was 400 MPa or more

Rejected: the 0.2% proof stress was less than 400 MPa (6) Evaluation of Microbial Corrosion Resistance Four test pieces having a length (rolling direction) of 500 mm and a width of 75 mm were collected from the hot-rolled annealed steel sheet thus obtained, and two welded test pieces were prepared with the following method.

That is, two test pieces were butted together to form a V-shaped groove with a bevel angle of 22.5 degrees and a root spacing of 5 mm. Next, a welded test piece was prepared by performing carbon dioxide arc welding under conditions of welding current: 190 A, arc voltage: 31V, and welding speed: 26 cm/min to 30 cm/min, using a WEL FCW329J3L wire having a wire diameter of 1.2 mm (manufactured by NIPPON WELDING ROD CO., LTD, where the main components were C: 0.015%, Si: 0.15%, Mn: 1.5%, Ni: 8%, Cr: 23%, Mo: 3%, and N: 0.15%). The flow rate of shielding gas of $CO_2$ was 20 L/min, and the number of passes was 4.

Next, six test pieces for evaluation having a length of 50 mm and a width of 50 mm were collected from the welded portion of the prepared welded test piece so that the welding direction was parallel to the longitudinal direction of the test piece for evaluation and the weld bead was at the center in the width direction of the test piece for evaluation. A part of 100 mm from the start and the end of the welded portion in the welding direction (longitudinal direction) was cut, respectively. Next, the test surface (the surface on the front side (the surface on the side of welding torch during welding)) of the test pieces for evaluation was polished with #600 abrasive paper.

The test pieces for evaluation were prepared for the following (a) antibacterial activity measurement and (b) biofilm adhesion resistance test, respectively (6 pieces×2), and the (a) antibacterial activity measurement and the (b) biofilm adhesion resistance test were conducted with the following methods.

(a) Antibacterial Activity Measurement

An antibacterial test was performed according to JIS Z2801 using the polished test pieces for evaluation in the same manner as in Example 1, the antibacterial activity against *Staphylococcus aureus* and the antibacterial activity against *Escherichia coli* were measured, and the microbial corrosion resistance was evaluated based on the following criteria. The evaluation results are also listed in Table 3.

Passed, particularly excellent: the antibacterial activity against *Staphylococcus aureus* and the antibacterial activity against *Escherichia coli* were both 2.0 or more Passed, excellent: the antibacterial activity against *Staphylococcus aureus* was 2.0 or more (excluding those of "passed, particularly excellent")

Rejected: the antibacterial activity against *Staphylococcus aureus* was less than 2.0

(b) Biofilm Adhesion Resistance Test

Three gap-shaped test pieces were prepared with the same method as in Example 1. Next, the prepared gap-shaped test pieces were immersed in the collected water in the same manner as in Example 1, and the formation (adhesion) of biofilm (cloudy adhesion like a thin film) in the gap of the gap-shaped test pieces were visually check.

The microbial corrosion resistance was evaluated based on the following criteria. The results are also listed in Table 3.

Passed, particularly excellent: no biofilm was observed in the gap in all of the three gap-shaped test pieces Passed, excellent: biofilm was adhered in the gap of one gap-shaped test piece Rejected: biofilm was adhered in the gap of two or more gap-shaped test pieces When the microstructure of the hot-rolled annealed steel sheets thus obtained was observed with the above-described method, it was found that the microstructure of any of the hot-rolled annealed steel sheets was composed of only two phases of an austenite phase and a ferrite phase, where the volume fraction of the austenite phase was in a range of 30% or more and 70% or less, and the volume fraction of the ferrite phase was in a range of 30% or more and 70% or less.

TABLE 3

| | | (5) Proof stress | | (6) Microbial corrosion resistance | | | | |
|---|---|---|---|---|---|---|---|---|
| | (4) Edge cracking | 0.2% proof | | (a) Antibacterial activity measurement | | | (b) Biofilm adhesion | |
| No. | resistance during hot rolling | stress (MPa) | Evaluation | *Staphylococcus aureus* | *Escherichia coli* | Evaluation | resistance test Evaluation | Remarks |
| 1 | Passed, particularly excellent | 471 | Passed | 2.5 | 1.0 | Passed, excellent | Passed, excellent | Example |
| 2 | Passed, particularly excellent | 446 | Passed | 3.7 | 1.0 | Passed, excellent | Passed, excellent | Example |
| 3 | Passed, excellent | 468 | Passed | 4.0 | 2.8 | Passed, particularly excellent | Passed, particularly excellent | Example |
| 4 | Passed, excellent | 465 | Passed | 4.1 | 2.7 | Passed, particularly excellent | Passed, particularly excellent | Example |
| 5 | Passed, particularly excellent | 448 | Passed | 3.2 | 1.7 | Passed, excellent | Passed, excellent | Example |
| 6 | Passed, particularly excellent | 442 | Passed | 4.5 | 2.2 | Passed, particularly excellent | Passed, particularly excellent | Example |
| 7 | Passed, excellent | 482 | Passed | 4.5 | 3.3 | Passed, particularly excellent | Passed, particularly excellent | Example |
| 8 | Passed, excellent | 478 | Passed | 4.0 | 4.2 | Passed, particularly excellent | Passed, particularly excellent | Example |
| 9 | Passed, particularly excellent | 489 | Passed | 3.1 | 1.8 | Passed, excellent | Passed, excellent | Example |
| 10 | Passed, particularly excellent | 473 | Passed | 4.4 | 2.7 | Passed, particularly excellent | Passed, particularly excellent | Example |
| 11 | Passed, particularly excellent | 466 | Passed | 3.0 | 1.1 | Passed, excellent | Passed, excellent | Example |
| 12 | Passed, particularly excellent | 449 | Passed | 3.2 | 1.9 | Passed, excellent | Passed, excellent | Example |
| 13 | Rejected | 447 | Passed | 3.4 | 1.8 | Passed, excellent | Passed, excellent | Comparative example |
| 14 | Rejected | 451 | Passed | 4.2 | 4.2 | Passed, particularly excellent | Passed, particularly excellent | Comparative example |
| 15 | Rejected | 456 | Passed | 4.0 | 5.2 | Passed, particularly excellent | Passed, particularly excellent | Comparative example |
| 16 | Rejected | 459 | Passed | 4.7 | 5.7 | Passed, particularly excellent | Passed, particularly excellent | Comparative example |
| 17 | Rejected | 466 | Passed | 4.0 | 5.0 | Passed, particularly excellent | Passed, particularly excellent | Comparative example |
| 18 | Rejected | 462 | Passed | 3.4 | 1.3 | Passed, excellent | Passed, excellent | Comparative example |
| 19 | Passed, particularly excellent | 453 | Passed | 1.2 | 0.5 | Rejected | Rejected | Comparative example |
| 20 | Passed, particularly excellent | 460 | Passed | 1.1 | 0.5 | Rejected | Rejected | Comparative example |

TABLE 3-continued

| No. | (4) Edge cracking resistance during hot rolling | (5) Proof stress 0.2% proof stress (MPa) | Evaluation | (6) Microbial corrosion resistance (a) Antibacterial activity measurement *Staphylococcus aureus* | *Escherichia coli* | Evaluation | (b) Biofilm adhesion resistance test Evaluation | Remarks |
|---|---|---|---|---|---|---|---|---|
| 21 | Passed, particularly excellent | 459 | Passed | 3.5 | 1.4 | Passed, excellent | Passed, excellent | Example |
| 22 | Passed, particularly excellent | 463 | Passed | 2.9 | 1.3 | Passed, excellent | Passed, excellent | Example |
| 23 | Rejected | 476 | Passed | 3.5 | 1.4 | Passed, excellent | Passed, excellent | Comparative example |
| 24 | Rejected | 480 | Passed | 3.6 | 1.8 | Passed, excellent | Passed, excellent | Comparative example |

According to Table 3, all the Examples had high proof stress and excellent microbial corrosion resistance, where the edge cracking during hot rolling was also effectively suppressed.

On the other hand, in the Comparative Examples, the microbial corrosion resistance was insufficient, or the edge cracking during hot rolling could not be effectively suppressed.

INDUSTRIAL APPLICABILITY

The austenitic-ferritic duplex stainless steel sheet of one embodiment of the present disclosure has both high proof stress and excellent microbial corrosion resistance, and furthermore, it can be produced with high productivity. Therefore, the austenitic-ferritic duplex stainless steel sheet of one embodiment of the present disclosure is suitable for use in structural members of underwater structures installed in water such as dams, sluice gates, and water treatment equipment.

The austenitic-ferritic duplex stainless steel sheet of one embodiment of the present disclosure can also be suitably used in cooking table members, kitchen floor plates, as well as automobile underside parts, and various supports and plant piping installed outside.

REFERENCE SIGNS LIST

1 austenitic-ferritic duplex stainless steel sheet
2 test piece for evaluation
3 weld bead
4 silicon tube

The invention claimed is:

1. An austenitic-ferritic duplex stainless steel sheet, comprising a chemical composition containing, in mass %, C: 0.100% or less,
Si: 1.00% or less,
Mn: 2.2% to 7.0%,
P: 0.07% or less,
S: 0.030% or less,
Cr: 18.0% to 24.0%,
Ni: 0.1% to 3.0%,
Mo: 0.01% to 1.00%,
Cu: 0.1% to 3.0%,
Ag: 0.010% to 0.120%, and
N: 0.15% to 0.30%, and
at least one selected from the group consisting of
B: 0.0010% to 0.0100%, and
REM: 0.010% to 0.100%,
with the balance consisting of Fe and inevitable impurities, wherein
the austenitic-ferritic duplex stainless steel sheet satisfies the following formula (1), $$(30\times[\%\ B]+1.2\times[\%\ REM])/[\%\ Ag]\geq 1.00 \quad (1)$$

where [% Ag], [% B] and [% REM] are the contents in mass % of Ag, B and REM in the chemical composition, respectively.

2. The austenitic-ferritic duplex stainless steel sheet according to claim 1, wherein the chemical composition further contains, in mass %, at least one selected from the group consisting of Al: 0.100% or less,
Ca: 0.0100% or less,
Mg: 0.0100% or less,
Ta: 0.10% or less,
Ti: 0.50% or less,
Nb: 0.50% or less,
Zr: 0.50% or less, and
V: 0.50% or less.

3. The austenitic-ferritic duplex stainless steel sheet according to claim 1, which is used for an underwater environment.

4. The austenitic-ferritic duplex stainless steel sheet according to claim 2, which is used for an underwater environment.

* * * * *